US006909089B2

(12) United States Patent
Londry et al.

(10) Patent No.: US 6,909,089 B2
(45) Date of Patent: Jun. 21, 2005

(54) METHODS AND APPARATUS FOR REDUCING ARTIFACTS IN MASS SPECTROMETERS

(75) Inventors: Frank R. Londry, Peterborough (CA); William R. Stott, King City (CA); Bruce A. Collings, Bradford (CA); James Hager, Mississauga (CA)

(73) Assignee: MDS Inc., Concord (CA)

( * ) Notice: Subject to any disclaimer, the term of this patent is extended or adjusted under 35 U.S.C. 154(b) by 0 days.

(21) Appl. No.: 10/449,912

(22) Filed: May 30, 2003

(65) Prior Publication Data

US 2004/0011956 A1 Jan. 22, 2004

Related U.S. Application Data

(60) Provisional application No. 60/384,655, filed on May 30, 2002.

(51) Int. Cl.[7] ..... H01J 49/42
(52) U.S. Cl. ..... 250/282; 281/292
(58) Field of Search ..... 250/282, 281, 250/292, 294

(56) References Cited

U.S. PATENT DOCUMENTS

| | | | | |
|---|---|---|---|---|
| 4,861,988 A | | 8/1989 | Henion et al. | |
| 4,963,736 A | | 10/1990 | Douglas et al. | |
| 5,248,875 A | | 9/1993 | Douglas et al. | |
| 5,420,425 A | | 5/1995 | Bier et al. | |
| 5,576,540 A | * | 11/1996 | Jolliffe | 250/292 |
| 5,847,386 A | | 12/1998 | Thomson et al. | |
| 6,111,250 A | | 8/2000 | Thomson et al. | |
| 6,177,668 B1 | | 1/2001 | Hager | |
| 6,504,148 B1 | * | 1/2003 | Hager | 250/282 |
| 2002/0175279 A1 | * | 11/2002 | Hager | 250/282 |

OTHER PUBLICATIONS

Gerlich, Dieter (1992) "Inhomogeneous RF Fields" *Advance in Chemical Physics Series* 74–81.

Loboda, Alexander et. al. (2000) "Novel Linac II Electrode Geometry for Creating an Axial Field in a Multipole Ion Guide" *Eur. J. Mass Spectrom* 6:531–536.

* cited by examiner

*Primary Examiner*—Nikita Wells
*Assistant Examiner*—Anthony Quash
(74) *Attorney, Agent, or Firm*—Barnes & Thornburg LLP; Alice O. Martin

(57) ABSTRACT

The invention solves the problem of artifact ghost peaks which can sometimes arise in mass spectrometers that employ a quadrupole rod set for both trapping and mass analyzing the trapped ions. The problem arises as a result of randomly distributed voltage gradients along the length of the rods. Three solutions are presented. The first approach involves improving the conduction characteristics of the rod sets. The second approach involves the application of at least one continuous axial DC field to the trapping quadrupole rod set in order to urge ions towards a pre-determined region of the trap, thereby avoiding voltage gradients. The third approach involves the application of one or more discrete axial fields to create one or more potential barriers along the axial dimension of the trap (in addition to the barriers used to initially trap the ions). These barriers prevent ions of differing voltage gradients from equilibrating with one another.

34 Claims, 11 Drawing Sheets

METHODS AND APPARATUS FOR REDUCING ARTIFACTS IN MASS SPECTROMETERS

This application claims priority to co-pending provisional patent application No. 60/384,655 filed May 30, 2002, incorporated herein by reference.

FIELD OF INVENTION

The invention relates generally to the field of mass spectrometers, and more particularly to the art of reducing or eliminating artifacts such as "ghost peaks" from mass scans obtained by mass analyzing ions contained in ion traps.

BACKGROUND OF INVENTION

Quadrupole mass analyzers have conventionally been used as flow-through devices, i.e., a continuous stream of ions enter and then exit the quadrupoles. More recently, however, the same quadrupole mass analyzer has been used as a combined linear ion trap and mass analyzer. That is, the linear ion trap accumulates and constrains ions within the quadrupole volume. The linear ion trap is characterized by an elongate multi-pole rod set in which a two dimensional RF field is used to constrain ions radially and DC barrier or trapping fields are used to constrain the ions axially. After a suitable fill time, the trapped ions are then scanned out mass dependently, for example, using a radial or axial ejection technique. Examples of quadrupole mass analyzers which combine ion trapping and mass analysis functions are described, inter alia, in U.S. Pat. No. 5,420,425 to Bier at al.; U.S. Pat. No. 6,177,668 to Hager; or in co-pending U.S. patent application Ser. No. 10/310,000, filed Dec. 4, 2002 and assigned to the assignee of the instant application. Each of these documents is incorporated herein by reference.

In such quadrupole mass analyzers, the mass scan sometimes reveals ghost peaks, i.e., satellite peaks that appear adjacent to the main peak, making the mass scan questionable. An example of this is shown in FIG. 1A, where a mass scan 78 features a main mass peak 82. The satellite peak 80, on the low side of the main peak 82, is a ghost peak or artifact. The small peak 84, on the high side of mass peak 82, is a legitimate isotope peak. These spectrograms were taken using a commercially available standard solution manufactured by Agilent™, product no. ES Mix G2421A, diluted in acetonitrile and water. Artifacts of these types have been observed on a number of mass spectrometers when a quadrupole rod set has been operated as a combined ion trap and mass analyzer. As mass increased, the severity of the artifact peaks increased in that the mass separation increased with mass, i.e., the problem was worst at high mass. The problem was also much more evident at slow scan speeds (e.g., 250 Da/s) when the resolution is the best. The age of the equipment and the length of the rods was also a factor. Depending on the parametric conditions, primarily the barrier potential on an end section member such as an exit lens used to trap ions axially, the artifact peaks could be minimized but at the expense of the main peak intensities. Again depending on the instrument and how it is set up the artifact peak can be either on the high or low mass side of the main peak.

SUMMARY OF INVENTION

The invention reduces and in certain cases can eliminate this undesirable phenomenon.

It is postulated that artifacts arise as a result of randomly distributed voltage gradients distributed along the length of the trapping quadrupole rod set. This causes spatially distributed and isolated ion populations of differing kinetic energies to exist in the ion trap. As the ions exit the trap, the isolated ion populations with the same m/z values will appear at the exit end at different times. Since ions exiting the trap can originate from anywhere along the entire length of the trap, ions of the same m/z values may not behave identically, causing the ghost peaks.

The invention provides three potential solutions to the artifact problem. The first approach involves improving the metallurgical properties of the rod sets, especially the conduction characteristics. The second approach involves the application of at least one continuous axial DC field to the trapping quadrupole rod set in order to urge ions towards a pre-determined region of the trap from which ions are eventually ejected, thus eliminating isolated ion populations. The third approach compartmentalizes the ion trap by applying at least one discrete axial fields to create a potential barriers along the axial dimension of the trap (in addition to the barriers used to initially trap the ions). These barriers prevent the isolated ion populations along the trap from equilibrating with one another.

According to one aspect of the invention, there is provided a method of operating a mass spectrometer having an elongate rod set which has an entrance end, a longitudinal axis, and a distal end. The method includes: (a) admitting ions into said rod set via the entrance end; (b) trapping at least some of the ions introduced into the rod set by producing an RF field between the rods and a barrier field adjacent to the distal end; (c) after trapping ions, establishing at least one additional barrier field in the interior of the rod set to define at least two compartments of trapped ions; (d) ejecting at least some ions of a selected mass-to-charge ratio from selected, but not all, of the compartments; and (e) detecting at least some of the ejected ions.

In preferred embodiments, ions are detected from only one of the compartments.

This method can be implemented on mass spectrometers where ions are ejected axially, i.e., along the longitudinal axis, or radially, i.e., transverse to the longitudinal axis. In the case of an axially ejecting spectrometer, the distal end functions as an exit end for the trapped ions and one additional barrier field is preferably produced such that the selected compartment is defined between the additional barrier field and the barrier field adjacent the distal/exit end. In the case of a radially ejecting mass spectrometer, the selected compartment can be defined anywhere along the rod set, preferably provided a detector is configured to detect ions ejecting substantially only from the selected compartment.

According to another aspect of the invention, a mass spectrometer is provided comprising: a multipole rod set, which defines a volume; power supply means connected to the rod set for generating an RF field in the volume in order to constrain ions of a selected range of mass-to-charge ratios along first and second orthogonal dimensions; means for introducing and trapping ions in the volume along a third dimension substantially orthogonal to the first and second dimensions; means for defining at least two compartments of trapped ions; and means for detecting ions from selected, but not all, of the compartments.

According to another aspect of the invention, an improvement is provided for an ion trap which employs a two-dimensional RF field to constrain ions in two dimensions and at least one barrier potential to constrain ions in a direction substantially normal to these two dimensions. The improvement includes: means for defining at least two compartments of trapped ions; and means for ejecting and detecting ions from at least one, but not all, of the compartments.

According to another aspect of the invention, there is provided another method of operating a mass spectrometer having an elongate rod set which has an entrance end, a longitudinal axis, and a distal end. The method includes: (a) admitting ions into the rod set via the entrance end; (b) trapping at least some of the ions introduced into the rod set by producing an RF field between the rods and by producing a barrier field adjacent the distal end; (c) establishing at least one DC field along the longitudinal axis in order to urge said trapped ions towards a pre-determined region of the volume defined by the rod set; (d) ejecting at least some ions of a selected mass-to-charge ratio from the pre-determined region; and (e) detecting at least some of the ejected ions.

This method can be implemented on mass spectrometers where ions are ejected axially or radially. In the case of an axially ejecting spectrometer, the distal end functions as an exit end for the trapped ions the ions are urged towards the distal end of the rod set. In the case of a radially ejecting mass spectrometer, the predetermined region can be situated anywhere along the rod set, preferably provided a detector is configured to detect ions ejecting substantially only from that region.

In preferred embodiments, the DC field(s) is established by a biased set of electrodes disposed adjacent to the rod set. Each of these electrodes has a T-shaped cross section including a stem, the depth of which varies over the length of the rod set in order to provide a substantially uniform electric field along the longitudinal axis.

BRIEF DESCRIPTION OF DRAWINGS

The foregoing and other aspects of the invention will become more apparent from the following description of specific embodiments thereof and the accompanying drawings which illustrate, by way of example only, the principles of the invention. In the drawings.

DETAILED DESCRIPTION OF ILLUSTRATIVE EMBODIMENTS

The inventors have theorized that the artifact problem may be attributed to metallurgical properties of the rods employed in linear ion traps ("LIT"), in conjunction with the geometry thereof. It was observed initially that swapping in a new set of rods, which are typically constructed from stainless steel, could solve this problem. It was also observed that in many cases when new rod sets were installed that no artifact peaks existed but after a period of many hours or even days the artifacts could re-appear.

Figure 2:
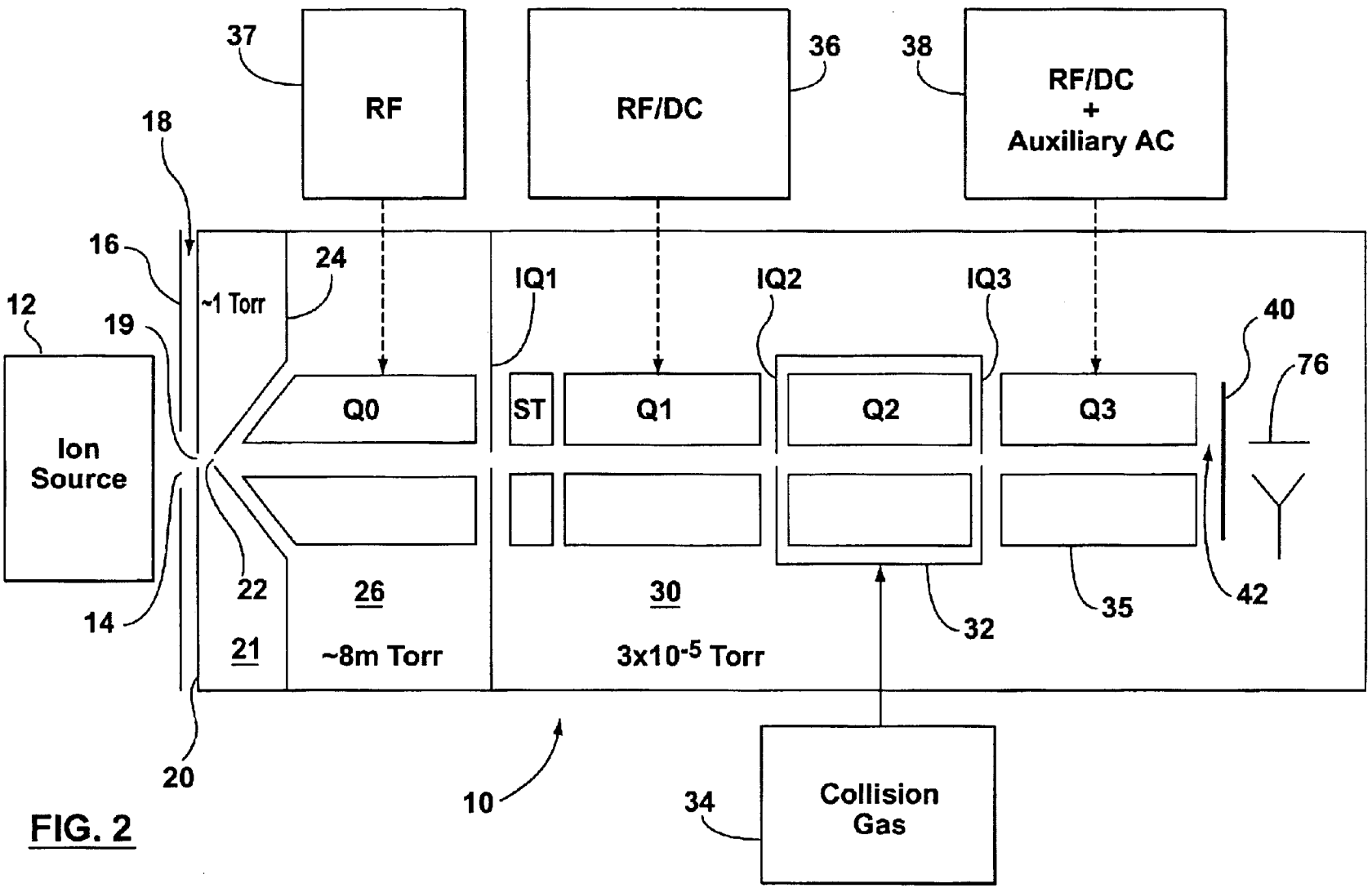
FIG. 2 is a schematic diagram of a triple-quadrupole mass spectrometer having a linear ion trap (Q3) with which the invention may be used.

FIG. 2 illustrates a triple-quadrupole mass spectrometer apparatus 10 in which one of the quadrupole rod sets, Q3, is operated as a combined linear ion trap and mass analyzer.

Experiments were conducted on such an apparatus, and the invention may be used with spectrometers such as, but not limited to, this type.

More particularly, the apparatus 10 includes an ion source 12, which may be an electrospray, an ion spray, a corona discharge device or any other known ion source. Ions from the ion source 12 are directed through an aperture 14 in an aperture plate 16. On the other side of the plate 16, there is a curtain gas chamber 18, which is supplied with curtain gas from a source (not shown). The curtain gas can be argon, nitrogen or other inert gas, such as described in U.S. Pat. No. 4,861,988, to Cornell Research Foundation Inc., which also discloses a suitable ion spray device. The contents of this patent are incorporated herein by reference.

The ions then pass through an orifice 19 in an orifice plate 20 into a differentially pumped vacuum chamber 21. The ions then pass through aperture 22 in a skimmer plate 24 into a second differentially pumped chamber 26. Typically, the pressure in the differentially pumped chamber 21 is of the order of 1 or 2 Torr and the second differentially pumped chamber 26, often considered to be the first chamber of the mass spectrometer, is evacuated to a pressure of about 7 or 8 mTorr.

In the chamber 26, there is a conventional RF-only multipole ion guide Q0. Its function is to cool and focus the ions, and it is assisted by the relatively high gas pressure present in chamber 26. This chamber 26 also serves to provide an interface between the atmospheric pressure ion source 12 and the lower pressure vacuum chambers, thereby serving to remove more of the gas from the ion stream, before further processing.

An interquad aperture IQ1 separates the chamber 26 from a second main vacuum chamber 30. In the second chamber 30, there are RF-only rods labeled ST (short for "stubbies", to indicate rods of short axial extent), which serve as a Brubaker lens. A quadrupole rod set Q1 is located in the vacuum chamber 30, which is evacuated to approximately 1 to $3\times10^{-5}$ Torr. A second quadrupole rod set Q2 is located in a collision cell 32, supplied with collision gas at 34. The collision cell 32 is designed to provide an axial field toward the exit end as taught by Thomson and Jolliffe in U.S. Pat. No. 6,111,250, the entire contents of which are incorporated herein by reference. The cell 32, which is typically maintained at a pressure in the range $5\times10^{-4}$ to $10^{-2}$ Torr, is within the chamber 30 and includes interquad apertures IQ2, IQ3 at either end. Following Q2 is located a third quadrupole rod set Q3, indicated at 35, and an exit lens 40.

Each rod in Q3 has a radius of about 10 mm and a length of about 120 mm, although other sizes are contemplated and may be used in practice. It is desirable for the rods to be as close to ideal configuration as possible, e.g., perfectly circular or having perfect hyperbolic faces, in order to achieve the substantial quadrupole field required for mass analysis. Opposing rods in Q3 are preferably spaced apart approximately 20 mm, although other spacings are contemplated and used in practice. The pressure in the Q3 region is nominally the same as that for Q1, namely 1 to $3\times10^{-5}$ Torr. A detector 76 is provided for detecting ions exiting axially through the exit lens 40.

Power supplies 37, for RF, 36, for RF/DC, and 38, for RF/DC and auxiliary AC are provided, connected to the quadrupoles Q0, Q1, Q2, and Q3. Q0 is operated as an RF-only multipole ion guide whose function is to cool and focus the ions as taught in U.S. Pat. No. 4,963,736, the contents of which are incorporated herein by reference. Q1 is a standard resolving RF/DC quadrupole. The RF and DC voltages are chosen to transmit only precursor ions of interest or a range of ions into Q2. Q2 is supplied with collision gas from source 34 to dissociate precursor ions to produce a fragment ions. Q3 was operated as a linear ion trap, and used to trap the fragment ions as well as any un-dissociated precursor ions. Ions are then scanned out of Q3 in a mass dependent manner using an axial ejection technique. Q3 can also function as a standard resolving RF/DC quadrupole.

In the illustrated embodiment, ions from ion source 12 are directed into the vacuum chamber 30 where, if desired, a precursor ion of a selected m/z value (or range of mass-to-charge ratios) may be selected by Q1 through manipulation of the RF+DC voltages applied to the quadrupole rod set as well known in the art. Following precursor ion selection, the ions are accelerated into Q2 by a suitable voltage drop between Q1 and Q2, thereby inducing fragmentation as taught by U.S. Pat. No. 5,248,875 the contents of which are hereby incorporated by reference. The degree of fragmentation can be controlled in part by the pressure in the collision cell, Q2, and the potential difference between Q1 and Q2. In the illustrated embodiment, a DC voltage drop of approximately 40–80 volts is present between Q1 Q2.

The fragment ions along with non-dissociated precursor ions are carried into Q3 as a result of their momentum and the ambient pressure gradient between Q2 and Q3. After a suitable fill time a blocking potential can be applied to IQ3 in order to trap the precursor ions and its fragments in Q3. Once trapped in Q3, the precursor ions and its fragments can be mass selectively scanned out of the linear ion trap, thereby yielding an MS/MS or $MS^2$ spectrum.

Figure 3:
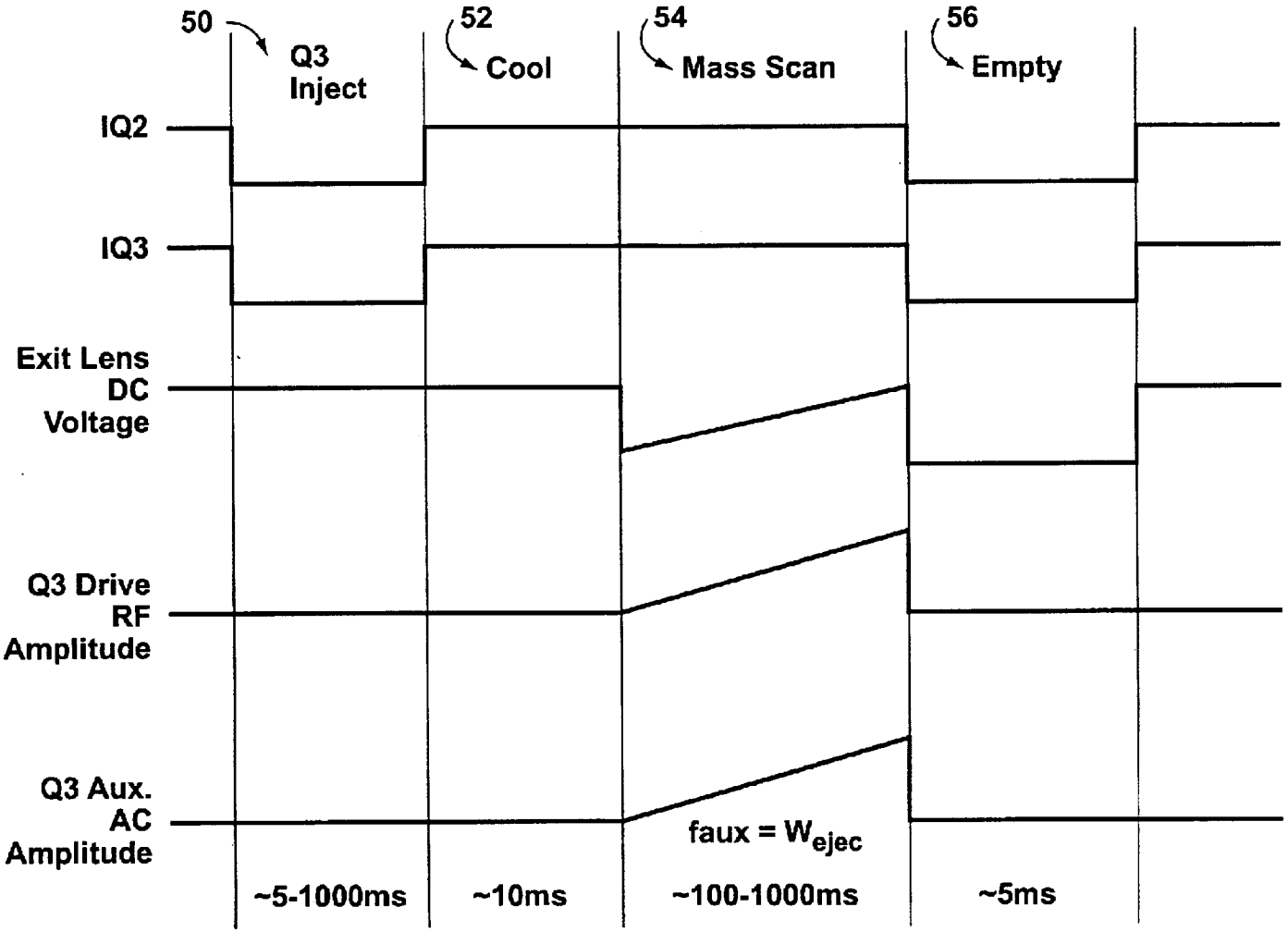
FIG. 3 is a timing diagram showing a variety of waveforms used to control the linear ion trap (Q3) shown in FIG. 2.

FIG. 3 shows the timing diagrams of waveforms applied to the quadrupole Q3 in greater detail. In an initial phase 50, a DC blocking potential on IQ3 is dropped so as to permit the linear ion trap to fill for a time preferably in the range of approximately 5–1000 ms, with 50 ms being preferred.

Next, a cooling phase 52 follows in which the ions in the trap are allowed to cool or thermalize for a period of approximately 10 ms in Q3. The cooling phase is optional, and may be omitted in practice.

A mass scan or mass analysis phase 54 follows the cooling phase, in which ions are axially scanned out of Q3 in a mass dependent manner. In the illustrated embodiment, an auxiliary dipole AC voltage, superimposed over the RF voltage used to trap ions in Q3, is applied to one set of pole pairs, in the x or y direction (being orthogonal to the axial direction. The frequency of the auxiliary AC voltage, $f_{aux}$, is preferably set to a predetermined frequency $\omega_{ejec}$ known to effectuate axial ejection. (Each linear ion trap may have a somewhat different frequency for optimal axial ejection based on its exact geometrical configuration.) Simultaneously, the amplitudes of the Q3 RF voltage and the Q3 auxiliary AC voltage are ramped or scanned. This particular technique enhances the resolution of axial ejection, as taught in co-pending U.S. patent application Ser. No. 10/159,766 filed May 30, 2002, assigned to the instant assignee. The contents of this document are incorporated herein in their entirety.

After mass scanning, in a next phase 56 Q3 is emptied of all ions. In this phase, all of the voltages are lowered to allow the trap to empty.

In investigating the artifact phenomenon, which in the apparatus 10 arises from Q3, it is known that the ions which are scanned axially out of the Q3 LIT can and do originate from anywhere along the length of the Q3 rod set, but ions of the same m/z value may not necessarily exit the trap at the same time. As such, it is believed that there are populations of ions along the length of the Q3 rod set that are isolated from one another by voltage gradients, i.e., different ion populations are energized to slightly varying voltage potentials, and thus have slightly differing kinetic energies. Experience has shown that different rod sets are likely to have different isolated ion populations, implying the existence of randomly distributed voltage gradients on the Q3 rod sets.

As such, some ion populations in the LIT can have different kinetic energies than other ion populations. It is thus expected that discrete or different ion populations will reflect off the voltage gradients or barriers including IQ3 and the exit lens at the opposing ends of the Q3 LIT. There may also be other mechanisms at play which result in randomly distributed voltage gradients or barriers that manifest along the length or axial dimension of Q3.

The randomly distributed voltage barriers or gradients affecting the transmission properties are believed to arise from non-uniformities of the surface potentials of the rods, probably as a result of different surface compositions, either elemental or oxides. Oxidation likely explains why the artifact effect occurs gradually. It is postulated that these irregularities cause variations in the work function on the rod surface thus varying the effective RF voltage amplitude at different positions along the rods. See Gerlich, Dieter., 'Inhomogeneous RF Fields: A Versatile Tool For The Study of Processes With Slow Ions', Advance in Chemical Physics Series, Vol. 52, pages 75–81, 1992.

There are three potential solutions to the artifact problem in LITs. The first approach involves improving the metallurgical properties of the rod sets, especially the conduction characteristics. The second approach involves the application of a continuous axial field to the LIT quadrupole rod set in order to urge ions towards the exit end of the trap, thus eliminating isolated ion populations. The behavior of the LIT was investigated when Linacs were used for this purpose. The third approach involves the application of discrete axial fields to create one or more potential barriers along the axial dimension of the trap. These barriers prevent the isolated ion populations along the trap from interfering with one another. The behaviour of the LIT was investigated when potential barriers were created through the use of biased metallized rings surrounding the quadrupole rod set. The second and third approaches provide a means for precluding isolated ion populations in detected ions. The first approach provides a means for improving the random potential gradients that arise from the metallurgical properties of the rods.

I. Improved Metallurgical Properties

One approach to reducing the artifact problem is to improve the metallurgical properties of the rod sets to have better conduction characteristics and less of a tendency to oxidize. The rod sets have traditionally been constructed from stainless steel, and manufactured using conventional machining methods. These methods are not always capable of meeting tight tolerance levels beyond a specific rod length (the high tolerances being important for achieving the substantial quadrupole field required for mass analysis), and so other materials and manufacturing techniques have been developed for providing precision-tolerance rod sets. For example, the assignee has developed relatively long rod sets using gold-plated ceramic rods. The following experiments were conducted using gold-plated ceramic rods and gold-plated stainless steel rods for the Q3 rods.

Using nine gold-coated rod sets, it was observed that 8 of 9 sets reduced artifact effects to acceptable levels in at least one orientation or the other (orientation being defined as the rods being disposed towards Q2 or alternatively towards the detector). Only one rod set passed in both orientations. It is postulated that the gold layer provides an improved uniform conductive layer therefore reducing random voltage barriers or gradients along the rods. However, gold-coating the rod sets only assisted in reducing the severity of the artifact peaks. It did not completely eliminate the phenomenon.

Instead of gold, other metallic amorphous coatings will suffice.

II. Continuous Axial Fields

Another approach centers on creating or providing one or more axial fields in the Q3 LIT. One type of axial field, termed herein as a "continuous" field, functions to push or urge the ions trapped along the entire length of Q3 towards the exit end of the rod set. This has the effect of congregating the trapped ions and eliminating discrete ion populations. The axial field also ensures that substantially all ions of a given m/z value selected for axial ejection exit the trap at substantially the same time.

Figure 4A:
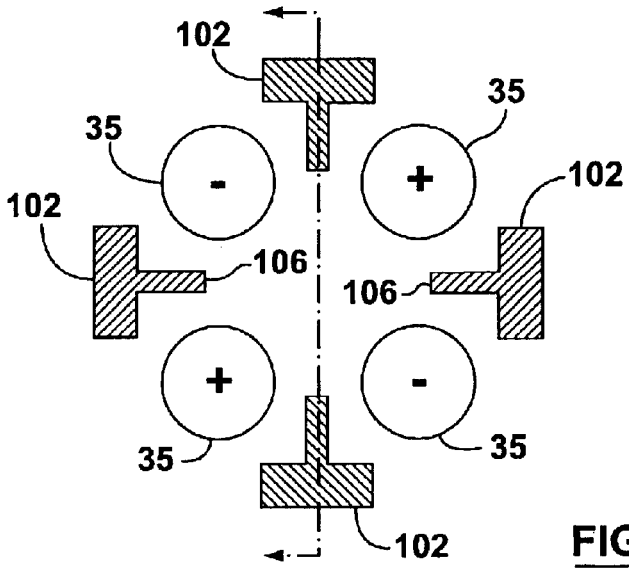
FIGS. 4A and 4B respectively show radial and axial cross-sectional views of a modified quadrupole rod set/linear ion trap fitted with linacs (extra electrodes) for producing an axial DC field.
Figure 4B:
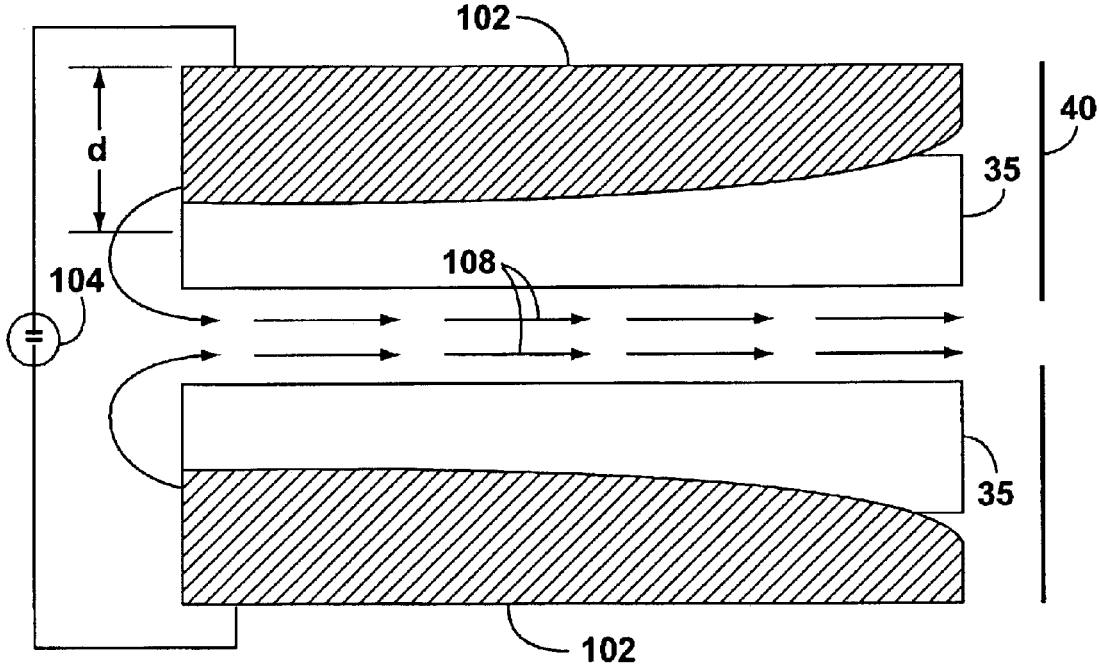

FIGS. 4A and 4B respectively show radial and axial cross-sectional views of "Manitoba"-style linacs 100, which are one example of an apparatus that can be used to apply a continuous axial field. The linacs include four extra electrodes 102 introduced between the main quadrupole rods 35 of Q3. While a variety of electrode shapes are possible, the preferred electrodes have T-shaped cross-sections. The linac electrodes are held at the same DC potential 104, but the depth, d, of the stem section 106 is varied as seen best in FIG. 4B to provide an approximately uniform electric field along the axial dimension of Q3. See Loboda et al., "Novel Linac II Electrode Geometry for Creating an Axial Field in a Multipole Ion Guide", Eur. J. Mass Spectrom., 6, 531–536 (2000), the contents of which are incorporated herein by reference, for more detailed information on this subject. The linacs 100 create a continuous DC axial field (symbolically represented by field lines 108) which applies a force that pushes the ions towards the exit end of the Q3 rod set. The artifacts phenomenon can be substantially eliminated using this approach.

Referring to FIG. 3, note that the axial field is preferably off during the ion injection phase 50, so the space charge characteristics of the trap are not affected. (If the axial field is on during fill time, then the fill time is reduced.) During ejection, as the ions exit, the space charge effects are insignificant and/o compensated for by the axial field.

It was found that different axial gradients were required for different rod sets to mitigate the ghost artifact peaks. Accordingly, different rod sets may have to be individually tuned. Experimentally, the an LIT length of about 20 mm required a potential gradient of 0.05 to 0.15 volts/cm. The value can be varied with application to compensate for variation between instruments. Also, axial fields of different polarity are required for positive and negative mode ions.

In employing the linacs 100, it was noted that there was some interaction between the linac fields near IQ3 that affect the transmission of ions into Q3 during the ion injection phase 50. This could be overcome by adjusting the position of the linacs 100 relative to the end of the rod set. More particularly, the DC field interacts with a fringing field created by IQ3 and the end of the Q3 rod set. This interaction has an affect on ions filling the trap in that it reduces the fill amount. In order to avoid this interaction, the end of the linac electrode is moved away from the end of the rod set by 1 to 4 mm. Typically, the fringing field penetrates into the rod set by a distance equivalent to about a ½ rod radius, or about 6 mm in the illustrated embodiment. So, about a 4 mm gap is sufficient to elevate this interaction. It also appears that normal RF/DC resolving mode of operation is not significantly affected by the presence of the linac hardware when appropriate voltages are applied.

A variety of other mechanisms can be used in the alternative to create a continuous axial field in a linear ion trap that will eliminate the artifact problem. A number of these are described in U.S. Pat. Nos. 5,847,386 or 6,111,250 to Thomson and Jollife, incorporated herein by reference. Although these patents describe the creation of an auxiliary axial field in a standard resolving quadrupole or a collision cell where ions are not trapped, nevertheless most of these can be used for an ion trap.

Figure 21:
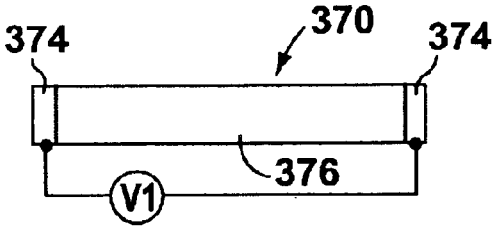
FIG. 21 is a side view of another modified rod set enabling the generation of an axial field for use in place of or in addition to one of the quadrupole rod sets of a linear ion trap.
Figure 22:
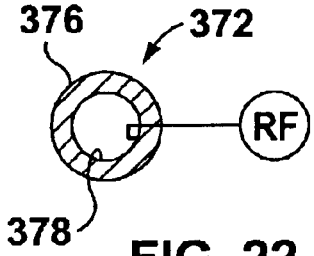
FIG. 22 is a cross-sectional view at the center of the rod of FIG. 21.

Briefly, as described in the patents above, axial fields can be created in one or more rod sets by: tapering the rods (FIGS. 8 to 11); arranging the rods at angles with respect to each other (FIGS. 12 to 15); segmenting the rods (FIGS. 16–17); providing a segmented case around the rods (FIGS. 18–19); providing resistively coated or segmented auxiliary rods (FIGS. 18–19); providing a set of conductive metal bands spaced along each rod with a resistive coating between the bands (FIG. 20); forming each rod as a tube with a resistive exterior coating and a conductive inner coating (FIGS. 21–22); a combination of any two or more of the above; or any other appropriate methods.

More particularly, FIGS. 8 to 11 show a tapered rod set 262 that provides an axial field. The rod set 262 comprises two pairs of rods 262A and 262B, both equally tapered. One pair 262A is oriented so that the wide ends 264A of the rods are at the entrance 266 to the interior volume 268 of the rod set, and the narrow ends 270A are at the exit end 272 of the rod set. The other pair 262B is oriented so that its wide ends 264B are at the exit end 272 of the interior volume 268 and so that its narrow ends 270B are at the entrance 266. The rods define a central longitudinal axis 267. Each pair of rods 262A, 262B is electrically connected together, with an RF potential applied to each pair (through isolation capacitors C2) by an RF generator 274 which forms part of power supply 248. A separate DC voltage is applied to each pair, e.g. voltage VI to one pair 262A and voltage V2 to the other pair 262B, by DC sources 276-1 and 276-2. The tapered rods 262A, 262B are located in an insulated holder or support (not shown) so that the centers of the rods are on the four corners of a square. Other spacing may also be used to provide the desired fields. For example the centers of the wide ends of the rods may be located closer to the central axis 267 than the centers of the narrow ends.

FIGS. 12 to 15 show a angled rod set 262 that provides an axial field, and in which primed reference numerals indicate parts corresponding to those of FIGS. 8 to 11. In FIGS. 8 to 11, the rods are of the same diameter but with the ends 264A$^1$ of one pair 262A$^1$ being located closer to the axis 267$^1$ of the quadrupole at one end and the ends 268B$^1$ of the other pair 262B$^1$ being located closer to the central axis 267$^1$ at the other end. In both cases described, the DC voltages provide an axial potential (i.e. a potential on the axis 267) which is different at one end from that at the other end. Preferably the difference is smooth, but it can also be a step-wise difference. In either case an axial field is created along the axis 267.

Figure 16:
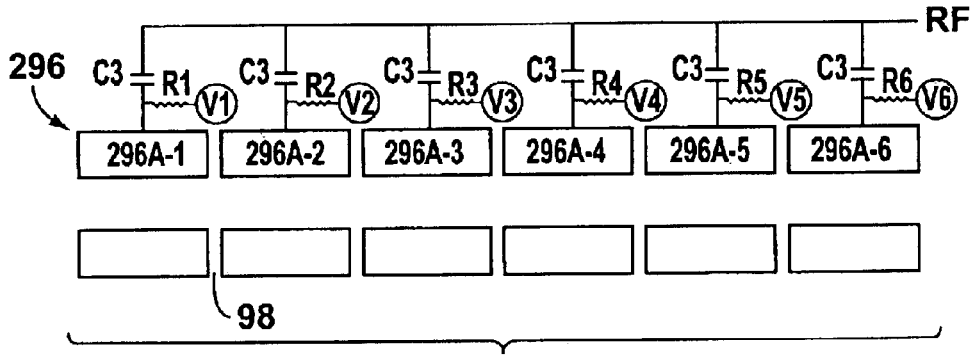
FIG. 16 is a side view of two rods of a modified rod set enabling the generation of an axial field for use in place of or in addition to one of the quadrupole rod sets of a linear ion trap.
Figure 17:
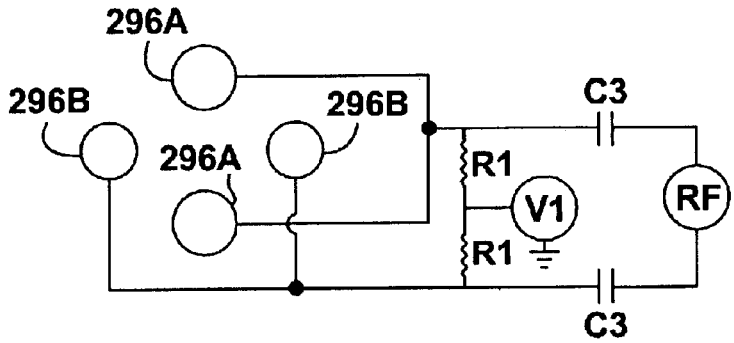
FIG. 17 is an end view of the rod set of FIG. 16 and showing electrical connections thereto.

FIGS. 16 and 17, show a segmented rod set 296 that provides an axial field, consisting of two pairs of parallel cylindrical rods 296A, 296B arranged in the usual fashion but divided longitudinally into six segments 296A-1 to 296A-6 and 296B-1 to 296B-6 (sections 296B-1 to 6 are not separately shown). The gap 298 between adjacent segments or sections is very small, e.g. about 0.5 mm. Each A section and each B section is supplied with the same RF voltage from RF generator 274, via isolating capacitors C3, but each is supplied with a different DC voltage V1 to V6 via resistors R1 to R6. Thus sections 296A-1, 296B-1 receive voltage V1, sections 296A-2, 296B-2 receive voltage V2, etc. This produces a stepped voltage along the central longitudinal axis 300 of the rod set 296, as shown at 302 in FIG. 16 which plots axial voltage on the vertical axis and distance along the rod set on the horizontal axis. The separate potentials can be generated by separate DC power supplies for each section or by one power supply with a resistive divider network to supply each section.

Figure 18:
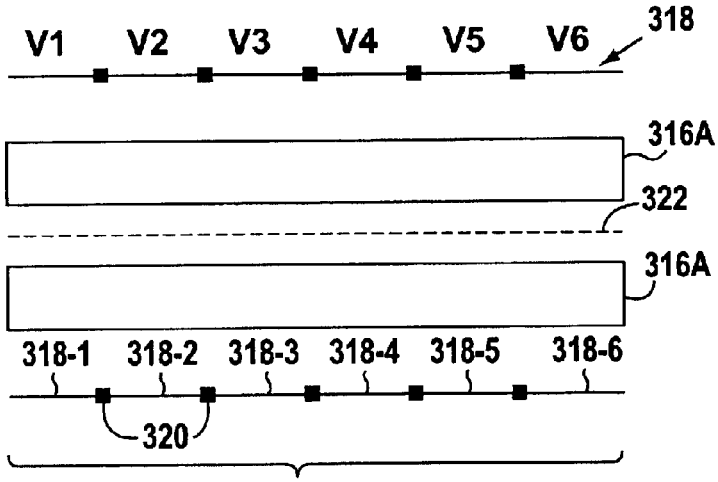
FIG. 18 is a side view of two rods of another modified rod set enabling the generation of an axial field for use in place of or in addition to one of the quadrupole rod sets of a linear ion trap.
Figure 19:
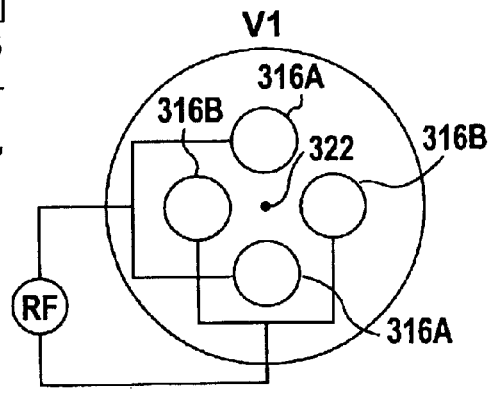
FIG. 19 is an end view of the rod set of FIG. 18 and showing electrical connections thereto.

FIGS. 18–19 show a segmented case around the rods providing an axial field. In this arrangement, the quadrupole rods 316A, 316B are conventional but are surrounded by a cylindrical metal case or shell 318 which is divided into six segments 318-1 to 318-6, separated by insulating rings 320. The field at the central axis 322 of the quadrupole depends on the potentials on the rods 316A, 316B and also on the potential on the case 318. The exact contribution of the case depends on the distance from the central axis 322 to the case and can be determined by a suitable modeling program. With the case divided into segments, an axial field can be created in a fashion similar to that of FIGS. 16–17, i.e. in a step-wise fashion approximating a gradient.

Figure 20:
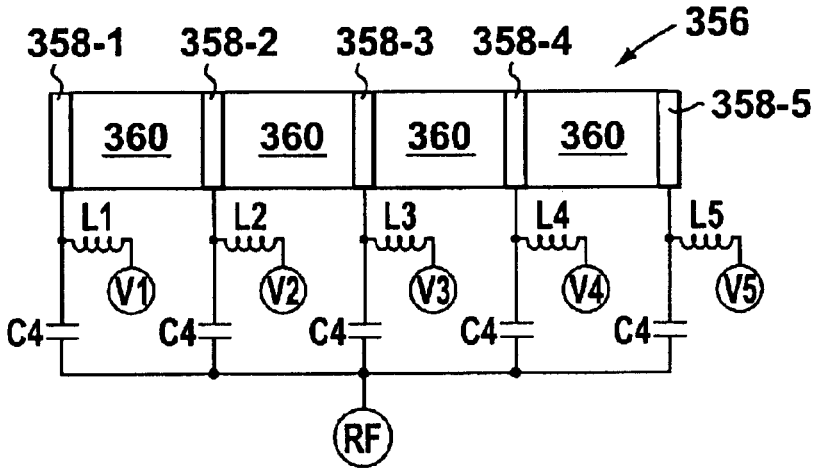
FIG. 20 is a side view of another modified rod set enabling the generation of an axial field for use in place of or in addition to on of the quadrupole rod sets of a linear ion trap.

FIG. 20 shows a set of conductive metal bands spaced along each rod with a resistive coating between the bands as a manner of providing an axial field. FIG. 20 shows a single rod 356 of a quadrupole. Rod 356 has five encircling conductive metal bands 358-1 to 358-5 as shown, dividing the rod into four segments 360. The rest of the rod surface, i.e. each segment 360 is coated with resistive material to have a surface resistivity of between 2.0 and 50 ohms per square. The choice of five bands is a compromise between complexity of design versus maximum axial field, one constraint being the heat generated at the resistive surfaces. RF is applied to the metal bands 358-1 to 358-5. Separate DC potentials V1 to V5 are applied to each metal band 358-1 to 358-5 via RF blocking chokes L1 to L5 respectively.

Figure 23:
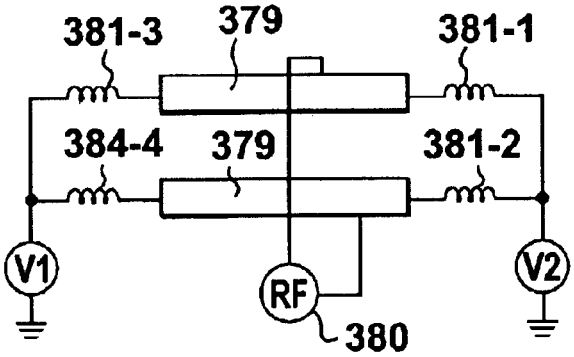
FIG. 23 is a diagrammatic view of yet another modified rod set.
Figure 24:
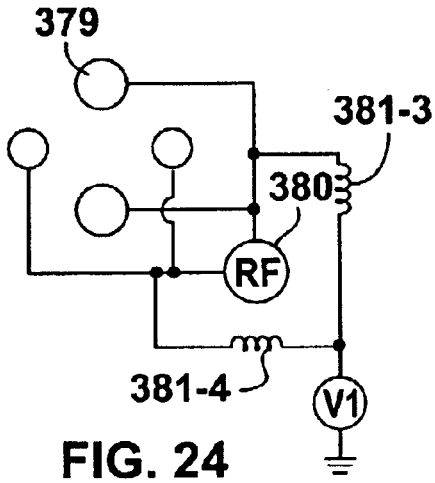
FIG. 24 is an end view of the rod set of FIG. 23.

FIGS. 21–24 show resistively coated or segmented auxiliary rods that provide an axial field. Rod 370 is formed as an insulating ceramic tube 372 having on its exterior surface a pair of end metal bands 374 which are highly conductive. Bands 374 are separated by an exterior resistive outer surface coating 376. The inside of the tube 372 is coated with conductive metal 378. The wall of tube 372 is relatively thin, e.g. about 0.5 mm to 1.0 mm. The surface resistivity of the exterior resistive surface 376 will normally be between 1.0 and 10 Mohm per square. A DC voltage difference indicated by V1 and V2 is connected to the resistive surface 376 by the two metal bands 374, while the RF is connected to the interior conductive metal surface 378. The high resistivity of outer surface 376 restricts the electrons in the outer surface from responding to the RF (which is at a frequency of about 1.0 MHz), and therefore the RF is able to pass through the resistive surface with little attenuation. A the same time voltage source V1 establishes a DC gradient along the length of the rod 370, again establishing an axial DC field. In FIGS. 23, 24 each quadrupole rod 379 is coated with a surface material of low resistivity, e.g. 300 ohms per square, and RF potentials are applied to the rods in a conventional way by RF source 380. Separate DC voltages V1, V2 are applied to each end of all four rods through RF chokes 381-1 to 381-4. The low resistance of the surface of rods 379 will not materially affect the RF field but will allow a DC voltage gradient along the length of the rods, establishing an axial field. The resistivity should not be too high or resistance heating may occur. (Alternatively external rods or a shell can be used with a resistive coating).

Figure 7A:
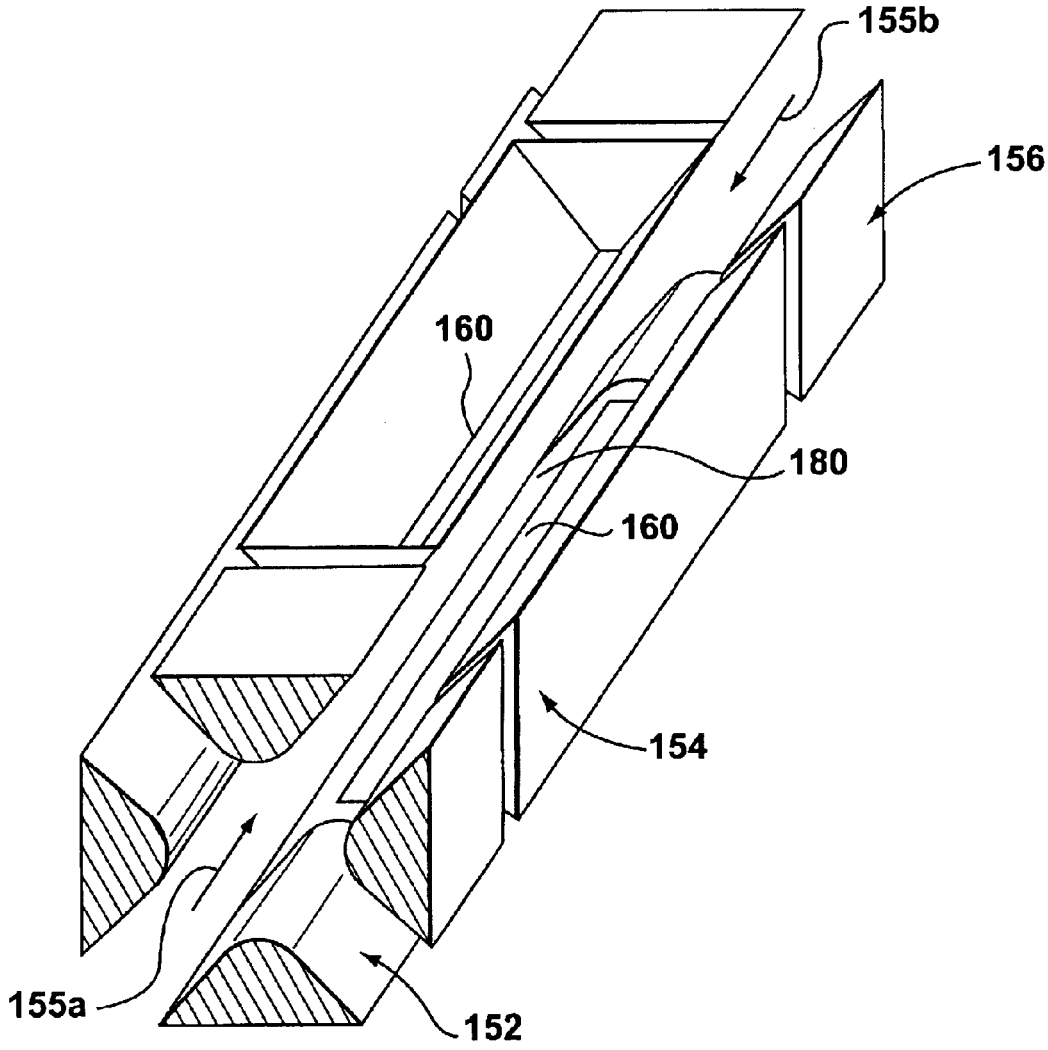
FIG. 7A is a schematic diagram of a modified quadrupole rod set/linear ion trap configured to detect ions ejected radially from the trap. The trap includes means for producing axial fields.

It should also be appreciated that a continuous axial field or fields can also be applied to an LIT in which the trapped ions are radially ejected for mass detection. An example of such an LIT 150 is shown in FIG. 7A, and comprises three sections: an elongate central section 154, an entrance end section 152 and an exit end section 156. Each section includes two pairs of opposing electrodes. In the trapping mode, the end sections 152, 156 are held at a higher DC potential than the central section 154. In order to fill the trap the DC potential on the entrance section 152 is lowered. After a suitable fill time, the DC potential is raised, causing a potential well to be formed in the central section 154 of the trap which constrains the ions axially.

Elongate apertures 160 are formed in the electrode structures of the central section 154 in order to allow the trapped ions to be mass-selectively ejected radially, in a direction orthogonal to the axial dimension of the trap. Select ions are made unstable in the quadrupolar fields through manipulation of the RF and DC voltages applied to the rods. Those ions situated along the length of the trap that have been rendered unstable leave the central section 154 through the elongate apertures 160. Alternatively, the apertures can be omitted and ions can be ejected radially in the space between the rods by applying phase synchronized resonance ejection fields to both pairs of rods in the central section 154. A detector, not shown, is positioned to receive the radially ejected ions.

The entrance end section 152 can be readily interchanged with a plate having a central aperture and the exit end section 156 can likewise be interchanged with a plate.

Instead of ejecting ions from the entire length of the rod set, two axial fields of opposing polarity (schematically illustrated by arrows 155*a* and 155*b*) can be established using any of the forgoing techniques to urge ions into a central region 180 of the central section 154, or to a specific point or area between the rods. The detector (not shown) can be shaped, or shielded, to receive or count only those ions emanating from the selected region. Alternatively, one axial field can be established to urge ions towards the entrance or end section 152 or 156, with an appropriately shaped or shielded detector employed to detect ions emanating only from such section.

III. Discrete Axial Fields

Figure 5:
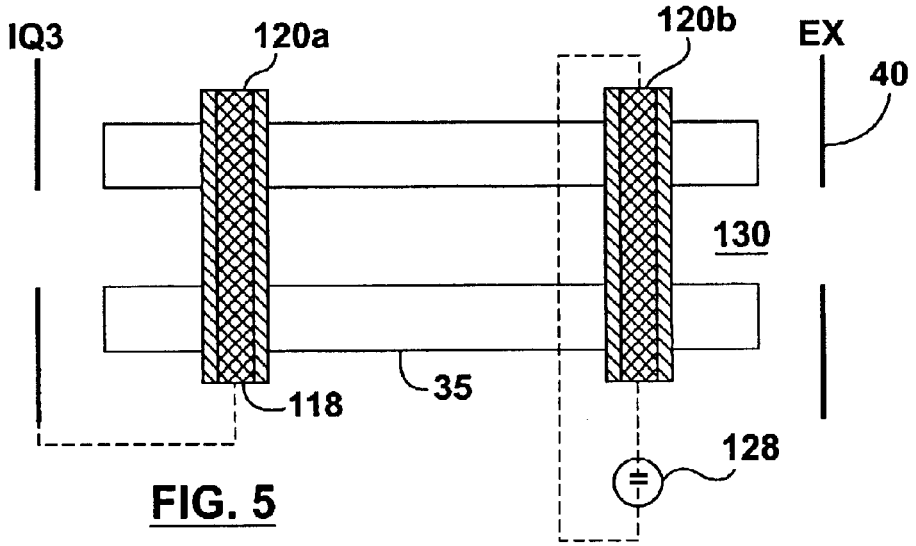
FIG. 5 is a perspective view of a modified quadrupole rod set/linear ion trap fitted with biased metalized rings for generating potential barriers along the axial dimension of the rod set.

As shown in the schematic diagram of FIG. 5, the quadrupole rod set of Q3 is supported near both ends by collars 118 made from a non-conductive material such as ceramic. Each collar 118 has a portion that can be metallized to form a conductive ring, 120*a* or 120*b*, around the circumference of the rod set while remaining electrically isolated from the rods 122 of the quadrupole. With an appropriately biased DC potential on each ring 120*a*, 120*b*, discrete voltage barriers can be created within the LIT volume because a small fraction of the radial electric field created by the rings 120*a*, 120*b* penetrates inside the quadrupole. See Thomson and Jollife, U.S. Pat. No. 5,847,386. By controlling the voltage barriers induced by the metal rings 120*a* and 120*b*, the ion populations within the Q3 LIT can be controlled. Preferably the IQ3 lens is electrically tied to the first or upstream metallized ring 120*a* and the second or downstream metallized ring 120*b* is controlled by an independent DC power supply 128.

Figure 1A:
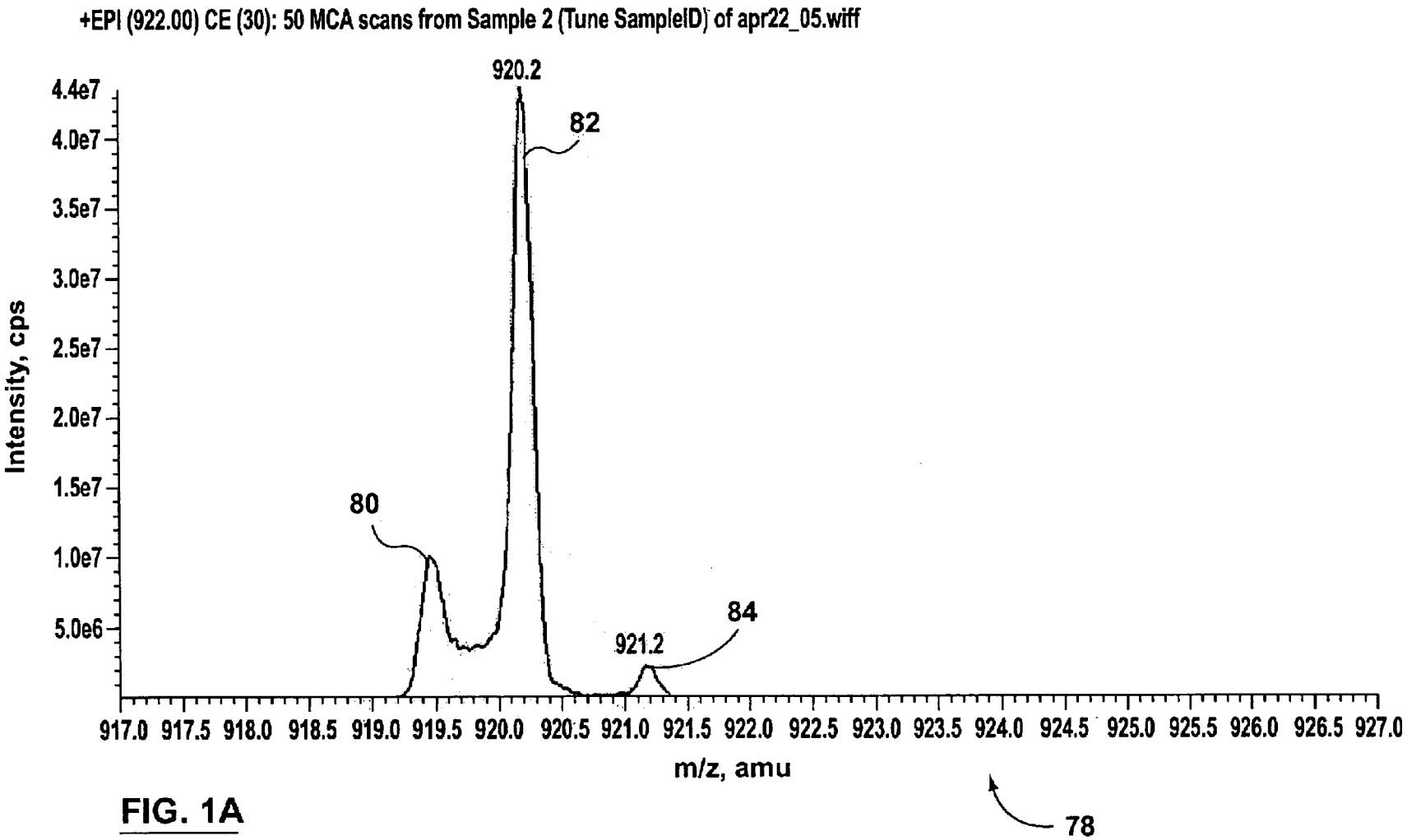
FIG. 1A is a mass spectrogram showing the existence of artifact ghost peaks.
Figure 1B:
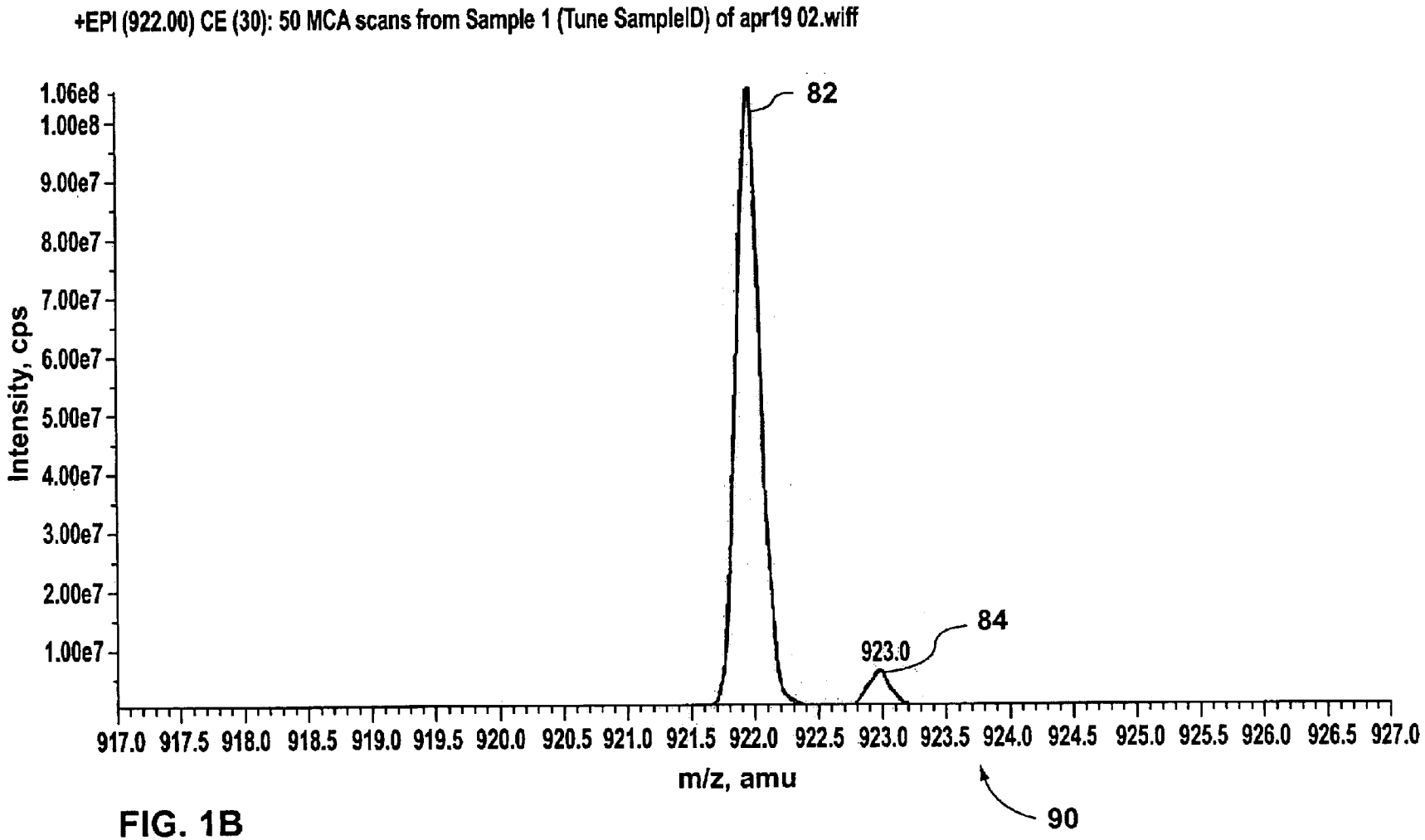
FIG. 1B is a mass spectrogram, obtained under conditions similar to FIG. 1A, without the artifact ghost peaks. This spectrogram was produced by employing the artifact-eliminating apparatus shown in FIG. 5.
Figure 6:
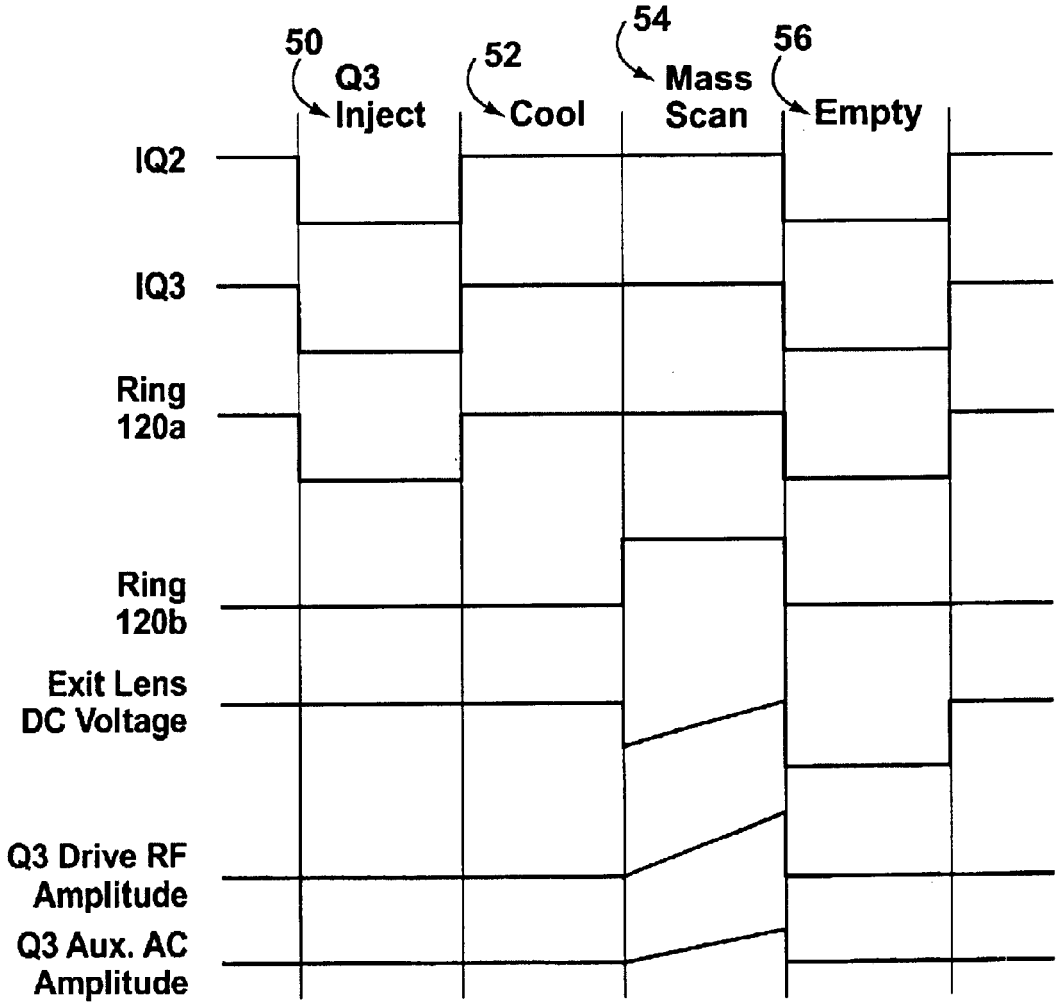
FIG. 6 is a timing diagram showing a variety of waveforms used to control the modified linear ion trap illustrated in FIG. 5.

As shown in the modified timing diagram of FIG. 6, during the mass scan out phase 56 the DC voltage on the IQ3 lens is dropped below the DC offset voltage on Q3 (not specifically shown) to prevent reflections of ions that were accelerated towards IQ3. Since the upstream metallized ring 120*a* is tied to IQ3 there is no significant voltage barrier induced by this ring 120*a* into Q3. However, if the downstream metallized ring 120*b* is appropriately biased, ions will be trapped in the region 130 between this ring 120*b* and the exit lens 40, whereby ions between ring 120*b* and IQ3 are prevented from entering region 130, which provides a trapped ion compartment. So, only those ions within the region 130 defined by ring 120*b* and the exit lens 40 will be axially ejected and recorded in the mass scan. This technique successfully eliminated the artifact problem, as shown in mass spectrum 90 of FIG. 1B which was taken under the same operating conditions as the mass scan of FIG. 1A but with the preferred metallized ring 120*b* installed and actuated.

It was found that the DC potential on the downstream ring 120*b* needed to be adjusted differently for different rod sets in order to eliminate ghost artifact peaks. The DC voltage applied to the downstream ring 120*b* varied from LIT to LIT. The voltage varied from as low as 200 V to as much as 1500 V. Note that if the potential on the metallized ring 120*b* was set too high, then peak tailing could occur on the high-mass side of the peaks.

Figure 8:
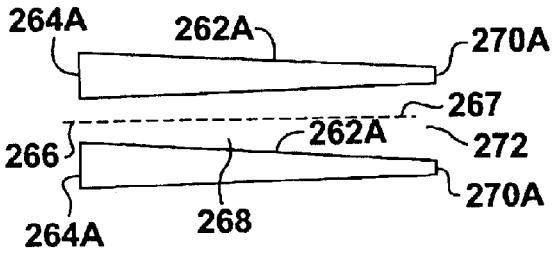
FIG. 8 is a side view of two rods of a tapered rod set enabling the generation of an axial field for use in place of or in addition to one of the quadrupole rod sets of a linear ion trap.
Figure 8B:
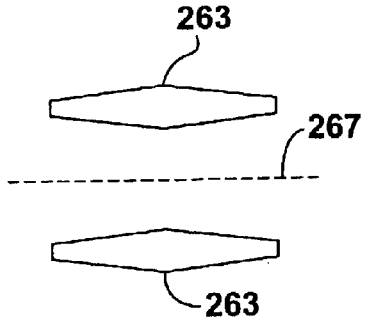
Figure 9:
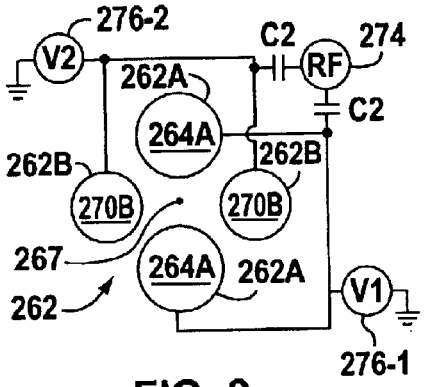
FIG. 9 is an end view of the entrance end of the FIG. 8 rod set.
Figure 10:
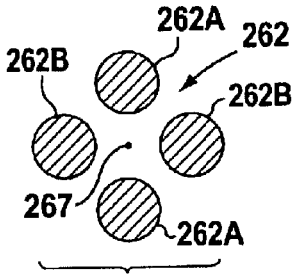
FIG. 10 is a cross-sectional view at the center of the rod set of FIG. 8.
Figure 11:
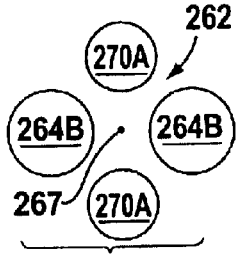
FIG. 11 is an end view of the exit end of the FIG. 8 rod set.
Figure 12:
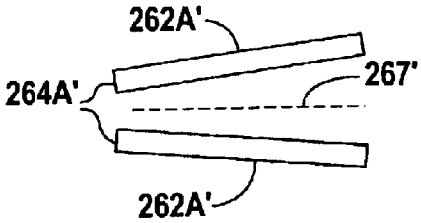
FIG. 12 is a side view of two rods of a modified rod set enabling the generation of an axial field for use in place of or in addition to one of the quadrupole rod sets of a linear ion trap.
Figure 13:
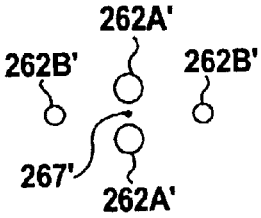
FIG. 13 is an end view of the entrance end of the FIG. 12 rod set.
Figure 14:
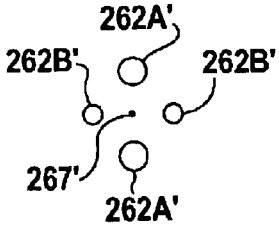
FIG. 14 is a cross-sectional view at the center of the FIG. 12 rod set.
Figure 15:
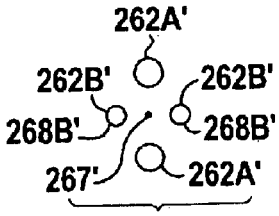
FIG. 15 is an end view of the exit end of the FIG. 12 rod set.

A variety of other mechanisms can be employed in the alternative to produce discrete potential barriers along the axial dimension of Q3. These include: segmenting the rods (as shown, for example, in FIGS. 16 and 17) and applying different DC offset voltages. Alternatively, as shown in FIG. 8B, the diameter of the rods can be tapered such that they have a larger diameter at the center 263 that than the ends.

Figure 7B:
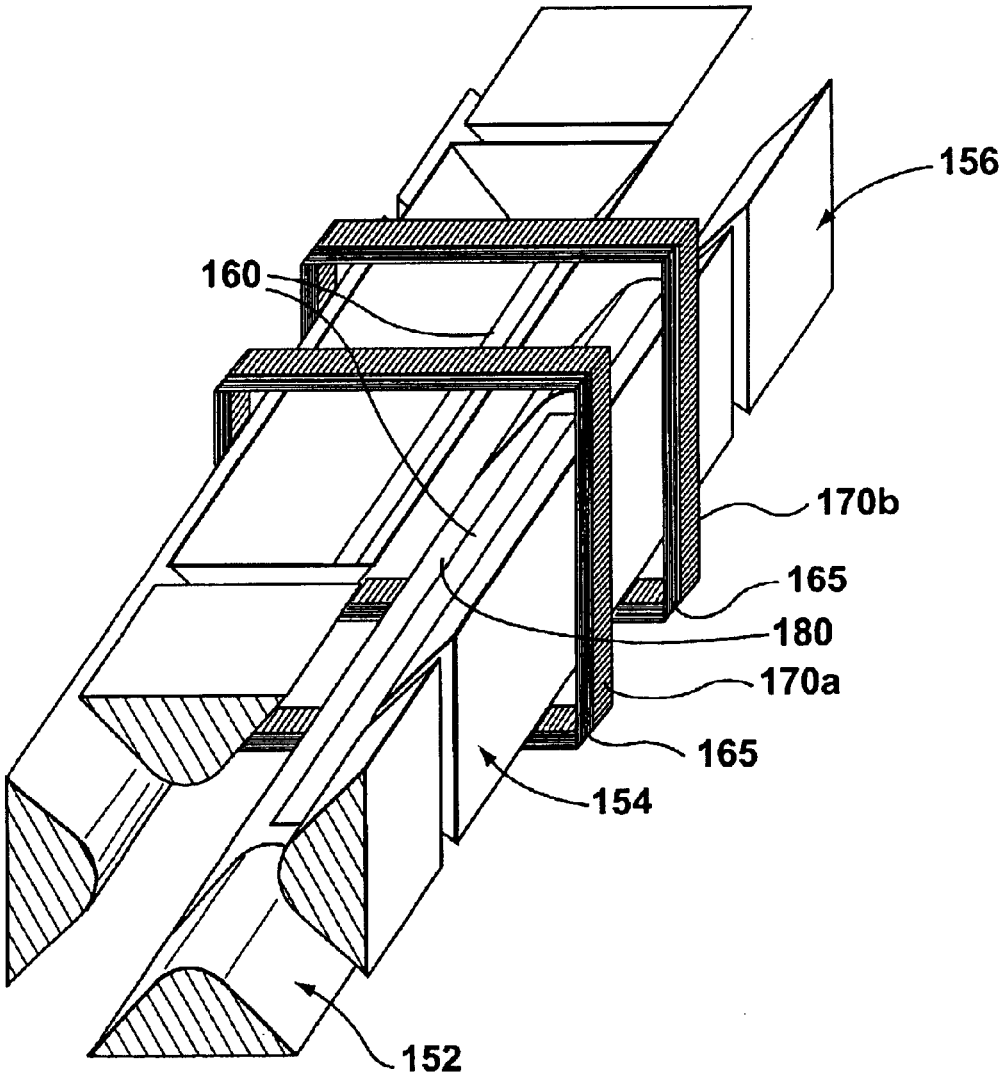
FIG. 7B is a schematic diagram of a modified quadrupole rod set/linear ion trap configured to detect ions ejected radially from the trap. The trap is fitted with biased metalized rings for generating potential barriers along the axial dimension of the rod set.

It should also be appreciated that these discrete axial field techniques can also be applied to an LIT in which the trapped ions are radially ejected for mass detection, as described above with reference to FIG. 7A, and modified appropriately as shown in FIG. 7B.

As shown in FIG. 7B, the rods of the central section 154 can be supported by non-conductive collars 165 made from a material such as ceramic. Each collar 165 has a portion that can be metallized to form a conductive ring, 170*a* or 170*b*, around the circumference of the rod set while remaining electrically isolated from the rods of the quadrupole. With an appropriately biased DC potential on each ring 170*a*, 170*b*, discrete voltage barriers can be created within the central section 154 because a small fraction of the electric field created by the rings 170*a*, 170*b* penetrates inside the central section 154. In operation, these barriers are applied after the trap has been filled in order to create a second potential well in a region 180 between the rings 170*a* and 170*b*. Ions are now prevented from leaving and entering this region 180, which provides a trapped ion compartment within the central section. The apertures 160 are shortened, or the detector is preferably shortened and/or shielded so as to count only those ions emanating from region 180. In this manner, any isolated ion populations that arise from random voltage gradients along the length of the trap are prevented from interfering with the mass scan, thereby minimizing the artifact phenomenon.

It will be appreciated that the compartment from which the trapped ions are ejected can alternately be the region defined between the entrance section 152 and the upstream ring 170*a*, or the region defined between the end section 156 and the downstream ring 170*b*. It will also be appreciated that while a triple quadrupole instrument has been presented and described, the invention can be used in a system where the rod sets upstream of the ion trap are omitted and an ion source is directly coupled to the combined ion trap/mass analyzer rod set. Similarly, those skilled in the art will appreciate that many modifications and variations may be made to the embodiments described herein without departing from the spirit of the invention.

What is claimed is:

1. A method of operating a mass spectrometer having an elongate rod set which has an entrance end, a longitudinal axis, and an end distal of said entrance end, the method including;

(a) admitting ions into said rod set via said entrance end;

(b) trapping at least some of the ions introduced into said rod set by producing an RF field between the rods and a barrier field adjacent to said distal end;

(c) after trapping ions, establishing at least one additional barrier field in the interior of said rod set to define at least two compartments of trapped ions;

(d) ejecting at least some ions of a selected mass-to-charge ratio from selected, but not all, of said compartments; and (e) detecting at least some of the ejected ions.

2. A method according to claim 1, wherein ions are detected from only one of said compartments.

3. A method according to claim 2, including producing a barrier field adjacent said entrance end, prior to step (c).

4. A method according to claim 3, wherein one additional barrier field is produced and said selected compartment is defined between said additional barrier field and said barrier field adjacent said distal end.

5. A method according to claim 4, wherein:

said distal end functions as an exit end for said ions;

said RF field and the barrier field adjacent said exit end interact in an extraction region adjacent to said exit end to produce a fringing field, said extraction region being located within said selected compartment; and ions in at least said extraction region are mass selectively energized to overcome the barrier field adjacent said exit end and are ejected from said rod set along the longitudinal axis.

6. A method according to claim 3, wherein said ions are ejected in one or more directions transverse to said longitudinal axis and ions substantially only from said selected compartment are detected.

7. A method according to claim 6, wherein each rod of said rod set includes an elongate aperture and ions are ejected through said apertures by operating the rod set in a mass-selective instability mode.

8. A method according to claim 6, wherein ions are ejected in said transverse direction by mass-selectively resonantly exciting the trapped ions.

9. A method according to claim 6, wherein one additional barrier field is produced and said selected trapped ion compartment is located between said additional barrier field and the barrier field adjacent said distal end.

10. A method according to claim 6, wherein two additional barrier fields are produced and said selected trapped ion compartment is located between said two additional barrier fields.

11. A method according to claim 6, wherein one additional barrier field is produced and said selected trapped ion compartment is located between said additional barrier field and the barrier field adjacent said entrance end.

12. A mass spectrometer, comprising:

a multipole rod set, which defines a volume;

power supply means connected to said rod set for generating an RF field in said volume in order to constrain ions of a selected range of mass-to-charge ratios along first and second orthogonal dimensions;

means for introducing and trapping ions in said volume along a third dimension substantially orthogonal to said first and second dimensions;

means for defining at least two compartments of trapped ions established by at least one barrier field in the interior of said rod set; and means for detecting ions from selected, but not all, of said compartments.

13. A device according to claim 12, wherein said compartmentalization means includes at least one DC biased conductive ring surrounding said volume.

14. A device according to claim 12, wherein ions are detected from only one of said compartments.

15. A device according to claim 14, wherein said means for introducing and trapping ions along said third dimension include means for producing a barrier field adjacent an ion entrance end of said rod set.

16. A device according to claim 15, wherein ions are ejected from said volume along said third dimension, and said means for trapping ions along said third dimension includes means for producing a barrier field adjacent an exit end of said rod set.

17. A device according to claim 16, wherein:

said RF field and the barrier field adjacent said exit end interact in an extraction region adjacent to said exit end to produce a fringing field, said extraction region being located within said selected compartment; and ions in at least said extraction region are mass selectively energized to overcome the barrier field adjacent said exit end and are ejected from said rod set along the said third dimension.

18. A device according to claim 15, wherein said ions are ejected along said first and second dimensions and ions substantially only from said selected compartment are detected.

19. A device according to claim 18, wherein each rod of said rod set includes an elongate aperture and ions are ejected through said apertures by operating the rod set in a mass-selective instability mode.

20. A device according to claim 18, wherein ions are ejected in said first and second dimensions by mass-selectively resonantly exciting the trapped ions.

21. In an ion trap which employs a two-dimensional RF field to constrain ions in two dimensions and at least one barrier potential to constrain ions in a direction substantially normal to said two dimensions, an improvement comprising:

means for defining at least two compartments of trapped ions established by at least one additional barrier field; and means for ejecting and detecting ions from at least one, but not all, of the compartments.

22. The improvement according to claim 21, wherein ions are detected from only one of said compartments.

23. A method of operating a mass spectrometer having an elongate rod set which has an entrance end, a longitudinal axis, and an end distal to said entrance end, the method including:

(a) admitting ions into said rod set via said entrance end;

(b) trapping at least some of the ions introduced into said rod set by producing an RF field between the rods and by producing a barrier field adjacent said distal end;

(c) urging said trapped ions towards a downstream compartmentalized region of the volume defined by said rod set the downstream region being established by at least one additional barrier field in the interior of said rod set;

(d) ejecting at least some ions of a selected mass-to-charge ratio from the region; and (e) detecting at least some of the ejected ions.

24. A method according to claim 23, wherein said urging of ions is accomplished by establishing at least one DC field along said longitudinal axis.

25. A method according to claim 24, wherein said DC field is established by a biased set of electrodes disposed adjacent to said rod set, each said electrode having a T-shaped cross section including a stem, the depth of the stem varying over the length of said rod set so as to produce a substantially uniform electric field along the longitudinal axis.

26. A method of operating a mass spectrometer having an elongate rod set which has an entrance end, an exit end, and a longitudinal axis, the method including:

(a) admitting ions into said rod set via said entrance end;

(b) trapping at least some of the ions introduced into said rod set by producing an RF field between the rods and by producing a barrier field adjacent to said exit end;

(c) establishing a DC field along the longitudinal axis in order to urge ions towards a downstream compartment at said exit end the downstream compartment being established by at least one additional barrier field in the interior of said rod set;

(d) axially ejecting at least some ions of a selected mass-to-charge ratio; and (e) detecting at least some of the ejected ions.

27. A method according to claim 26, wherein said DC field is established by a biased set of electrodes disposed adjacent to said rod set.

28. A method according to claim 27, wherein each said electrode has a T-shaped cross section including a stem, the depth of the stem varying over a pre-determined length of said rod set.

29. A method of operating a mass spectrometer having an elongate rod set which has an entrance end, a longitudinal axis, and an end distal of said entrance end, the method including:

(a) admitting ions into said rod set via said entrance end;

(b) trapping at least some of the ions introduced into said rod set by producing an RF field between the rods and by producing a barrier field adjacent to said distal end;

(c) establishing at least one DC field along said longitudinal axis in order to urge ions towards a downstream compartmentalized region along said longitudinal axis the downstream region being established by at least one additional barrier field in the interior of said rod set;

(d) ejecting at least some ions of a selected mass-to-charge ratio in a direction transverse to said longitudinal axis; and (e) detecting at least some of the ejected ions.

30. A method according to claim 29, wherein said DC fields are established by one or more biased sets of electrodes disposed adjacent to said rod set.

31. A method according to claim 30, wherein each said electrode has a T-shaped cross section including a stem, the depth of the stem varying over a pre-determined length of said rod set.

32. A mass spectrometer, comprising:

an elongate rod set which has an entrance end, a longitudinal axis, and an end distal to said entrance end, said rod set defining a volume;

means for admitting ions into said rod set via said entrance end;

means for trapping at least some of the ions introduced into said rod set by producing an RF field between the rods and by producing a barrier field adjacent said distal end;

means for establishing at least one DC field along said longitudinal axis in order to urge said trapped ions towards a downstream compartmentalized region of the volume defined by said rod set the downstream region being established by at least one additional barrier field in the interior of said rod set;

means for ejecting at least some ions of a selected mass-to-charge ratio from the region; and means for detecting at least some of the ejected ions.

33. A device according to claim 32, wherein said DC fields are established by one or more biased sets of electrodes disposed adjacent to said rod set.

34. A device according to claim 33, wherein each said electrode has a T-shaped cross section including a stem, the depth of the stem varying over a pre-determined length of said rod set.

* * * * *